US006378540B2

(12) United States Patent
Iwasa

(10) Patent No.: US 6,378,540 B2
(45) Date of Patent: Apr. 30, 2002

(54) WALKING ASSISTANCE DEVICE AND WALKING ASSISTANCE ATTACHMENT FOR THE DEVICE

(75) Inventor: Takastugi Iwasa, Taki-gun (JP)

(73) Assignees: Takatsugi Iwasi; Kazuyoshi Maeda, both of (JP)

( * ) Notice: Subject to any disclaimer, the term of this patent is extended or adjusted under 35 U.S.C. 154(b) by 0 days.

(21) Appl. No.: 09/725,628

(22) Filed: Nov. 29, 2000

(30) Foreign Application Priority Data

Nov. 30, 1999 (JP) ..... 11-340705

(51) Int. Cl.[7] ..... A61H 3/00

(52) U.S. Cl. ..... 135/65; 135/66; 135/82; 135/84

(58) Field of Search ..... 135/65, 66, 72, 135/74, 75, 82, 84

(56) References Cited

U.S. PATENT DOCUMENTS 4,299,246 A * 11/1981 Marsh ..... 135/65
4,884,587 A * 12/1989 Mungons ..... 135/65
6,055,997 A 5/2000 Greenstadt et al.

FOREIGN PATENT DOCUMENTS

JP 11-309187 11/1999

* cited by examiner

*Primary Examiner*—Beth A. Stephan
*Assistant Examiner*—Brian E. Glessner
(74) *Attorney, Agent, or Firm*—Rossi & Associates

(57) ABSTRACT

A walking assistance device for assisting ambulatory movement of a user afflicted with Parkinson's disease is disclosed. The device includes a body member, a shaft member fixedly disposed in a lower end portion of the body member so as to extend generally in a first horizontal direction, a longitudinal projection member disposed rotatably about the shaft member so as to extend in a direction perpendicular to the shaft member, and a mass member integrally formed with and disposed so as to oppose to the longitudinal projection member in a diametric direction of the shaft member. The longitudinal projection member is held in its protruding position where the longitudinal projection member protrudes outwardly from the body member and extend in the second horizontal direction, owing to ground pressure applied to the mass member, and is held in its retracting position where the longitudinal projection member extends in the vertical direction on the side of the body member, owing to gravity acting on the mass member. The longitudinal projection member held in its protruding position serves as a walking obstacle to the user, so that the user is induced to step over the walking obstacle.

12 Claims, 6 Drawing Sheets

WALKING ASSISTANCE DEVICE AND WALKING ASSISTANCE ATTACHMENT FOR THE DEVICE

This invention is based on Japanese Patent Application No. 11-340705 filed Nov. 30, 1999 the contents of which are hereby incorporated by reference.

BACKGROUND OF THE INVENTION

1. Field of the Invention

The present invention relates to a walking assistance device which is novel in construction and which is capable of facilitating or assisting ambulatory movement of a user afflicted with certain conditions, such as Parkinson's disease.

2. Description of the Related Art

Patients afflicted with Parkinson's disease experience reduction in number of spontaneous and autonomic movements, and suffer from walking disturbance, i.e., difficulty in ambulatory movement, for example. More specifically described, such Parkinson's patients are incapable of taking a step or stride forward for initiating their ambulatory movement, so that they are subject to danger of falling forward with high possibility, even where the ambulatory movement of the patients are assisted by means of a general walking assistance device, such as a walking cane. That is, such a conventional walking cane is of no use for the Parkinson's patients.

It is well known that the Parkinson's patients can overcome their difficulty in ambulatory movement and walk, if the patient or patient's brain is forcedly ordered to take a motion of stepping forward. Some patients can perform the normal walking reflexes, once they can start the ambulatory movement. In view of this specific symptom of the Parkinson's disease, an assistive walking cane suitable for Parkinsonians has been proposed as disclosed in JP-A-11-309187. The disclosed cane includes an elongated body member and a movable plate member which is rotatably coupled to a lower portion of the elongated body member. The elongated body member is telescopically deformable by means of a coil spring incorporated therein. The rotatable plate member is alternately placed in its open and closed positions in association with the telescopic motion of the elongated body member. The disclosed cane is arranged such that when the user lifts the cane, the elongated body member is expanded due to the expansion of the coil spring, whereby the rotatable plate member is held in its closed position where the rotatable member is vertically oriented so as to extend substantially parallel to the elongated body member. When the user leans on the cane and the user's load or weight accordingly acts on the elongated body member, on the other hand, the elongated body member is axially contracted due to the compression of the coil spring, whereby the rotatable plate member is held in its open position where the rotatable plate member is horizontally oriented so as to extend in a direction perpendicular to the axial direction of the elongated body member. The horizontally extending rotatable plate member projected in front of the user's foot serves as a walking obstacle especially to Parkinson's user of the cane. Encountering the walking obstacle stimulate the Parkinson's user to step over the obstacle, enabling the Parkinson's user to walk forward or start his or her ambulatory movement.

However, the conventional walking cane for the Parkinsonians as disclosed in the above-indicated document employs the coil spring for enabling the telescopic motion of the elongated body member which induces the alternative rotational displacement of the rotational plate member between its open and closed portion. Excessively large spring force of the coil spring causes insufficient contraction of the elongated body member, resulting in failure of placing the rotational plate member in its open position. On the other hand, excessively small spring force of the coil spring causes insufficient expansion of the elongated body member, resulting in failure of retracting the rotatable plate member to its closed position. Therefore, the conventional cane needs to be adjusted in its spring force depending on respective patient. If the spring force of the coil spring of the cane is adjusted to be a smaller value, the rotatable plate member is likely to suffer from insufficient retraction thereof to its closed position due to fatigue or sinking of the coil spring. It is significantly difficult to adjusting a suitable spring force of the coil spring, whereby the conventional cane for the Parkinson's patient lacks of long-term stability of its operation condition. In particular, if the rotatable plate member is not duly retracted to its closed position due to the fatigue of the coil spring, the rotatable plate member is very much likely to protrude outwardly from the elongated body member in the generally horizontal direction, eventually possibly interfering the ambulating movement of the user or patient.

SUMMARY OF THE INVENTION

The present invention has been developed in view of the circumstances described above. It is therefore a first object of the present invention to provide a walking assistance device which is novel in construction and which is capable of alternately placing a longitudinal projection member, with high stability and reliability, in two operation positions, namely a "retracting position" for accommodation of the projection member, and a "protruding position" for protrusion of the projection member into a path of movement of user's foot. The projection member placed at a protruding position stimulates the user to step over the projection member, thereby effectively supporting ambulatory movement of the user afflicted with certain conditions, such as Parkinson's disease.

It is a second object of the present invention to provide a walking assistance attachment which is attachable to conventional walking assistance devices or walking aids, such as a cane, for providing the ambulatory assistance device according to the present invention.

The first object may be achieved according to the following modes of the invention each of which is numbered like the appended claims and depends from the other mode or modes, where appropriate, to indicate possible combinations of elements or technical features of the invention. It is to be understood that the present invention is not limited to those modes of the invention and combinations of the technical features, but may otherwise be recognized based on the thought of the present invention that disclosed in the whole specification and drawings or that may be recognized by those skilled in the art in the light of the disclosure in the whole specification and drawings.

(1) A walking assistance device for assisting ambulatory movement of a user, including: a body member to which a weight of the user is applied; a shaft member fixedly disposed in a portion of the body member on the side of a walking surface so as to extend generally in a first horizontal direction; a longitudinal projection member disposed rotatably about the shaft member so as to extend in a direction perpendicular to the shaft member; and a mass member which is disposed so as to oppose to the longitudinal projection member in a diametric direction of the shaft member, and which is integrally formed with the longitudinal projection member. The mass member has a contact portion at which the device is brought into contact with the walking surface. The contact portion is offset from an axis of the shaft member by a predetermined distance in a second horizontal direction perpendicular to the first horizontal direction so that a ground pressure applied to the mass member produces a rotation moment which causes rotation of the longitudinal projection member about the shaft member in one direction. The longitudinal projection member is held in a protruding position where the longitudinal projection member protrudes outwardly from the body member generally in the second horizontal direction, owing to the rotation moment produced by the ground pressure applied to the mass member, and is held in a retracting position where the longitudinal projection member extends in a generally vertical direction, owing to gravity acting on the mass member.

In the walking assistance device according to the above mode (1) of the present invention, the contact portion of the mass member is subjected to the ground pressure, when the user put the walking assistance device on the walking surface, i.e., the ground, so as to lean on the walking assistance device. Since the contact portion of the mass member is offset from the axis of the shaft member by a predetermined distance in the second horizontal direction, the ground pressure applied to the mass member produces the rotation moment or a torque causing the rotation of the mass member and the longitudinal projection member about the shaft member in one direction, so that the longitudinal projection member protrudes outward from the body member so as to extend in the second horizontal direction. In this condition, the longitudinal projection member is provided in front of the user's foot and served as a walking obstacle to the user, e.g., a Parkinson's patient, effectively stimulating or inducing the user to step over the obstacle in order to overcome the obstacle. That is, the longitudinal projection member is effective to give a chance for the Parkinson's patient to start his or her ambulatory movement.

Once the user lifts the walking assistance device, the mass member is released from the ground pressure, and then is subjected to gravity. The gravity applied to the mass member produces a rotation moment or a torque causing a rotation of the mass member and longitudinal projection members about the shaft member so that the longitudinal projection member is retracted toward the body member, whereby the longitudinal projection member is held in the retracting position so as to extend in the vertical direction on the side of the body member. Thus, the longitudinal projection member is effectively accommodated or retracted on the side of the body member, when the user lifts to carry forward the walking assistance device. In this arrangement, the longitudinal projection member does not interrupt the ambulatory movement of the user.

In particular, the longitudinal obstacle member is arranged to be held in the retracting position, by utilizing the rotation moment caused by the gravity acting on the mass member rather than the spring force of the spring member. This arrangement can provide a desired retracting force required for retracting and holding the longitudinal projection member in the retracting position with a long-term stability, while eliminating the problem of instability of the retracting force due to the fatigue or settling of the spring member which is conventionally employed to provide the required force. Further, once the walking assistance device is placed at the contact portion of its mass member on the walking surface, the ground pressure applied to the mass member cancels the gravity acting on the mass member. Excess ground pressure is further applied to the contact portion of the mass member, whereby the ground pressure produces the rotation moment which causes the rotational movement of the longitudinal projection member away from the body member, for holding the longitudinal projection member in the protruding position where the longitudinal projection member is horizontally oriented. This arrangement can also provide the rotation moment in the direction toward the protruding position with a long-term stability. Thus, the present invention is effective to provide the desired walking assistance device which is capable of alternately holding the longitudinal projection member in the retracting and protruding positions with long-term stability. It should be understood that the walking assistance device includes various types of walking aid such as canes, walking sticks, crutches, and walker device. Further, the shaft member may be directly disposed in the body member, or alternatively be indirectly disposed in the body member.

(2) A walking assistance device according to the above-indicated mode (1), wherein the walking assistance device is a cane, and the body member includes a longitudinal portion, while the shaft member fixedly disposed in one of axially opposite end portion of the longitudinal portion on the side of the walking surface so as to extend in a direction perpendicular to an axis of the longitudinal portion. In this mode (2), the walking assistance device in the form of the cane is made compact and portable, further facilitating ambulatory movement of the user.

(3) A walking assistance device according to the above-indicated mode (1) or (2), wherein the body member includes an accommodation recess for accommodating the longitudinal projection member which is held in the retracting position.

In the walking assistance device according to this mode (3), the longitudinal projection member held in its retracting position is effectively accommodated within the accommodation recess formed in the body member, eliminating or reducing an amount of projection of the longitudinal projection member outward from the body member. This arrangement is effective and reliable to prevent adverse effects of the longitudinal projection member held in the retracting position on the ambulatory movement of the user, resulting in improved safety and ease in handling of the device.

(4) A walking assistance device according to any one of the above-indicated modes (1)–(3), wherein the mass member has a spherical shape. In this mode (4), the mass member having the spherical shape permits that the ground pressure is applied to the mass member with high stability, leading to improved stability of operation of the walking assistance device. In addition, the spherical mass member is less likely to be caught in the other obstacles on the walking surface, and is less likely to injure the user upon contact with the user's body, resulting in improved safety of the walking aid.

(5) A walking assistance device according to any one of the above-indicated modes (1)–(4), wherein the walking assistance device further comprises a stop member to limit an amount of rotational displacement of the longitudinal projection member relative to the body member in a direction toward the retracting position of the longitudinal projection member.

In this mode (5), the position of the mass member relative to the shaft member is suitably determined with high stability, when the longitudinal projection member is held in the retracting position, whereby a load center of the ground pressure applied to the mass member is determined with high stability, resulting in high stabilized generation of the rotation moment causing the rotation of the longitudinal projection member about the shaft member in the direction away from the body member, in other words, in the direction toward the protruding position. It should be noted that the stop member is not particularly limited to the member which is brought into contact directly with the longitudinal projection member to define the fully retracted position of the longitudinal projection member, but may otherwise be a member which is brought into contact with a portion on the side of the mass member in order to indirectly define the fully retracted position of the longitudinal projection member.

The second object indicated above may be achieved according to any one of the following forms of the present invention:

(6) A walking assistance attachment which is attachable to a walking assistance device for providing the walking assistance device according to any one of the above-indicated modes (1)–(5), the attachment including: the shaft member; and the longitudinal projection member disposed rotatably about the shaft member, the attachment being attachable to a portion of a body member of the walking assistance device, which portion is located on the side of the walking surface.

The attachment constructed according to the present invention, facilitates repair of malfunction of the walking assistance device by only changing or repairing the attachment, without requiring entire renewing of the walking assistance device. In addition, the attachment of the present invention can be fixed to the tip portion of a commercially available walking assistance device, such as canes, walking sticks, crutches, and walker devices, whereby the walking device provided with the attachment can exhibit the same advantage of the walking assistance device according to the present invention as described above.

BRIEF DESCRIPTION OF THE DRAWINGS

The above and other objects features, advantages and technical and industrial significance of the present invention will be better understood by reading the following detailed description of the presently preferred embodiments of the invention, when considered in connection with the accompanying drawings, in which.

DETAILED DESCRIPTION OF THE PREFERRED EMBODIMENTS

Figure 1:
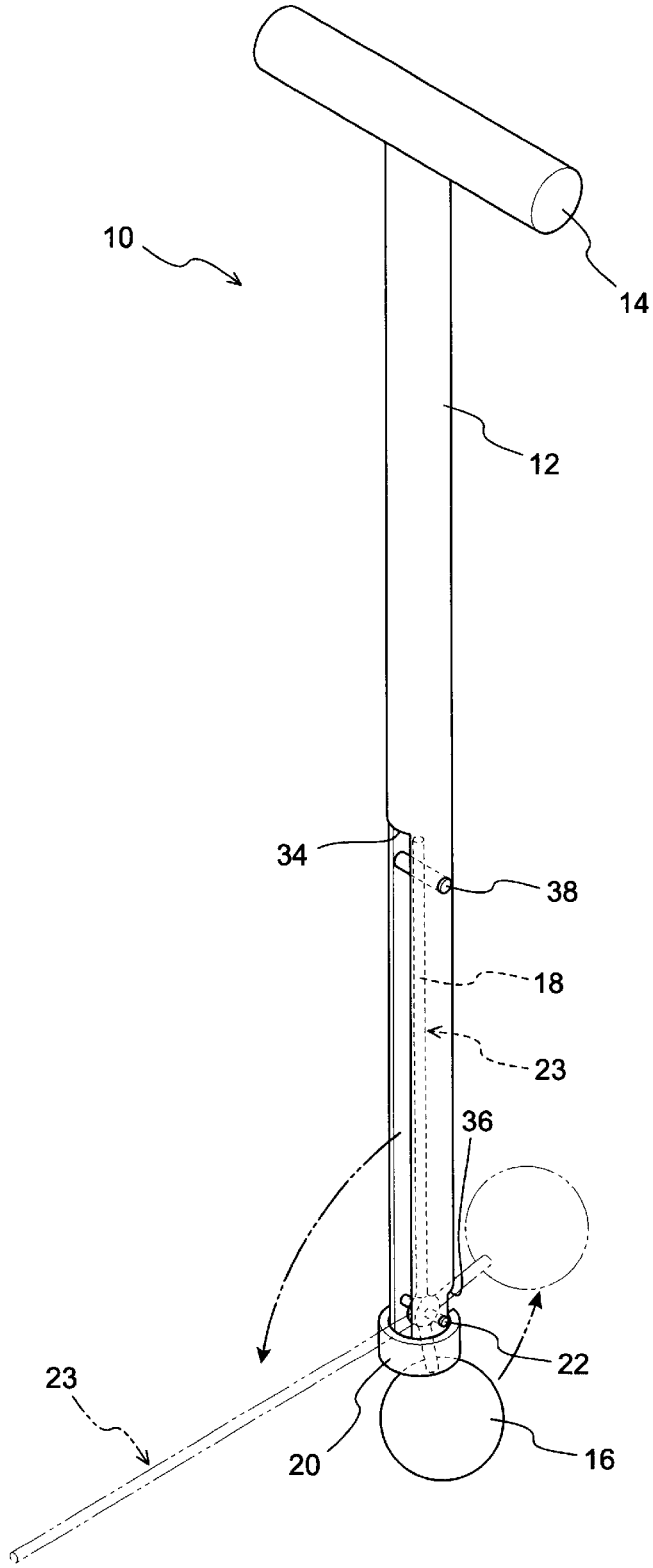
FIG. 1 is a perspective view showing one embodiment of an ambulatory assistance cane of the present invention.

Referring first to FIG. 1, there is shown an ambulatory assistance cane 10 constructed according to the present invention. The ambulatory assistance cane 10 includes a longitudinal stick member 12 as a body member and a handle 14 fixed to the axially upper end of the longitudinal stick member 12 as seen in FIG. 1. The term "cane" will be used to signify various walking assistance devices such as canes, walking sticks, crutches and four-legged metal walker device.

More specifically described, the longitudinal stick member 12 is of tubular construction and is made of rigid materials such as metal and reinforcing resin materials. The handle 14 fixed to the axially upper end of the longitudinal stick member 12 is a rod-shaped member and extends in a direction perpendicular to the axial direction of the longitudinal stick member 12. It is noted that the handle 14 provided in the present walking assistance cane 10 may be formed with a desired configuration including an arc shape and an inverted "L" shape. The longitudinal stick member 12 has a first window 34 and a second window 36 both formed in the axially lower end portion thereof and open in respective circumferential portions thereof that are opposed to each other in a diametric direction thereof. The first window 34 extends in the axial direction of the longitudinal stick member 12 with a constant circumferential width and a suitable axial length. On the other hand, the second window 36 extends in the axial direction of the longitudinal stick member 12 with an axial length which is smaller than that of the first window 34. In order to close the axially lower open end of the longitudinal stick member 12, a tip end cover 20 made of a metallic or synthetic resin material is radially outwardly disposed on the axially lower open end of the longitudinal stick member 12. That is the axially lower end portions of the first and second window 34, 36 are substantially closed or covered by the tip end cover 20, thereby reinforcing the lower end portion of the longitudinal stick member 12.

Figure 2:
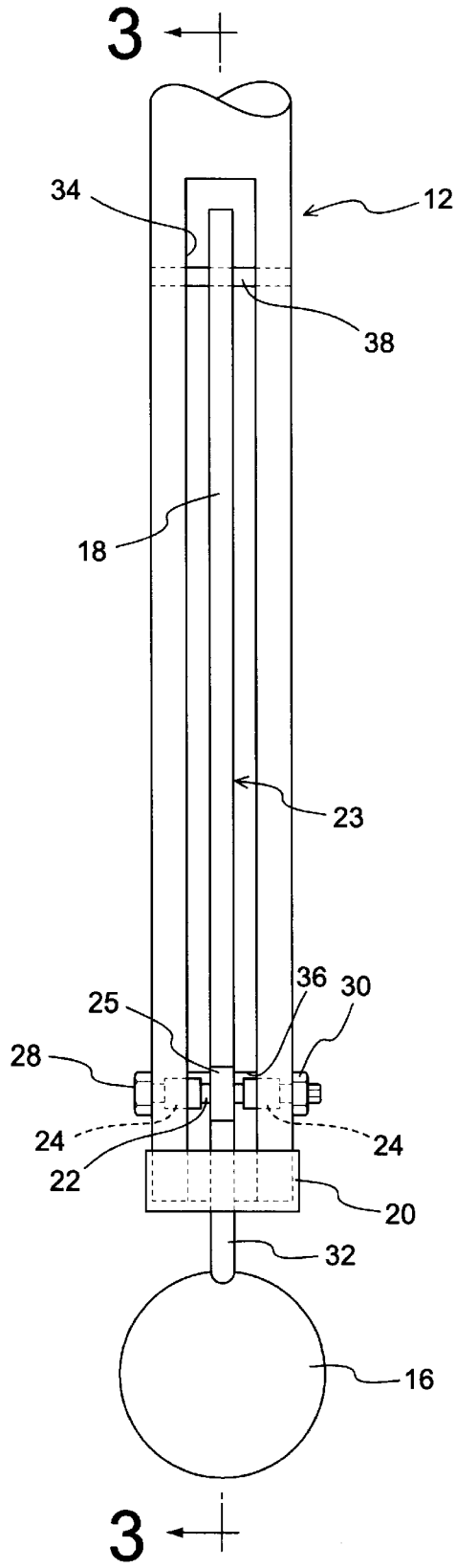
FIG. 2 is a fragmentally enlarged plane view showing a principal part of the cane of FIG. 1.
Figure 3:
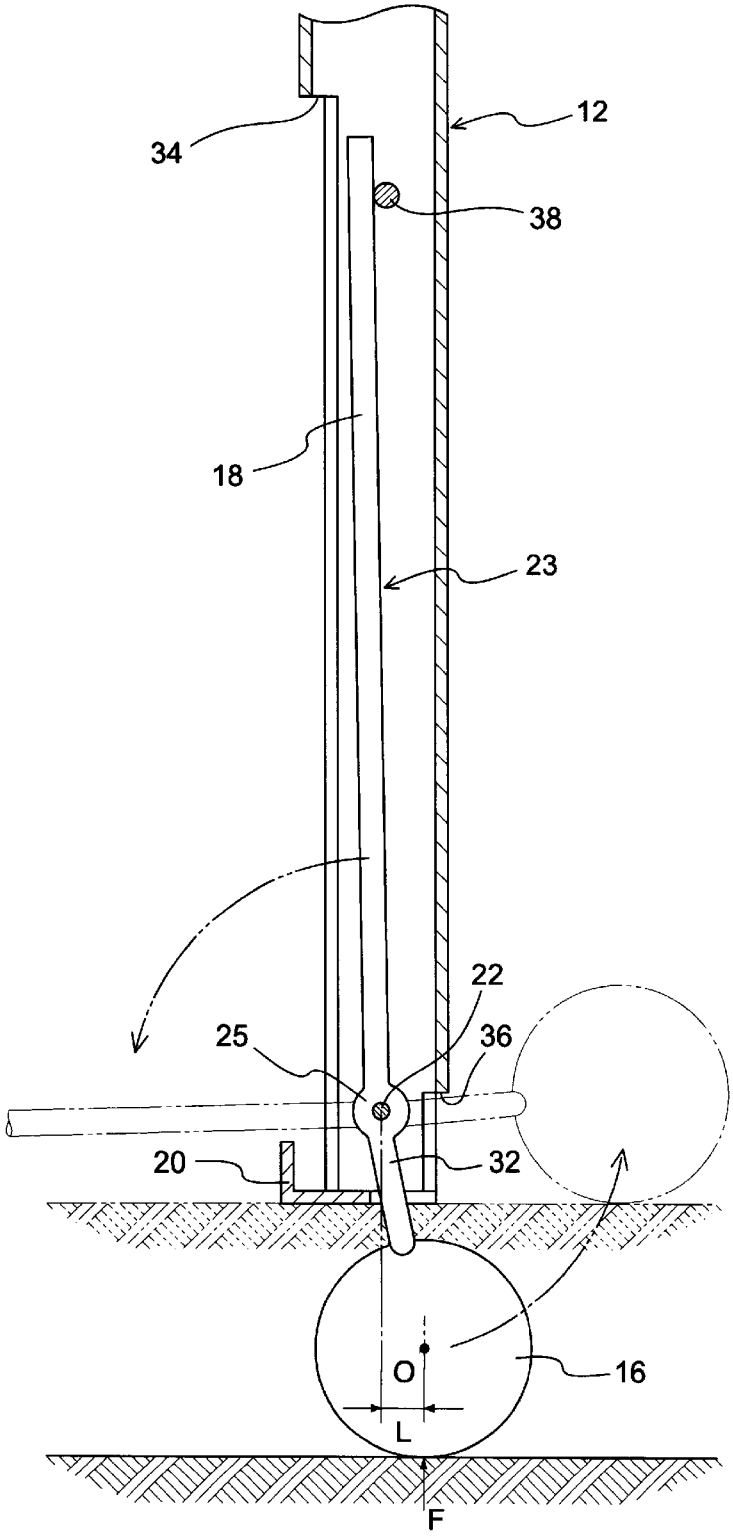
FIG. 3 is a cross sectional view taken along line III—III of FIG. 2.

Referring next to FIGS. 2 and 3, a center shaft 22 is disposed in the axially lower end portion of the longitudinal stick member 12 such that the center shaft 22 as a shaft member extends in a direction perpendicular to the axial direction of the longitudinal stick member 12, and in a direction perpendicular to the diametric direction of the longitudinal stick member 12 in which the first and second windows 34, 36 are opposed to each other. In the present embodiment, the center shaft 22 is fixed to the longitudinal stick member 12 by screwing a nut 30 on a threaded bolt 28 which penetrates the bore of the center shaft 22 and the longitudinal stick member 12 in the diametric direction of the longitudinal stick member 12.

The ambulatory assistance cane 10 further includes a rotation member 23 made of a rigid material such as metal and disposed radially outwardly of the center shaft 22. The rotation member 23 includes a cylindrical sleeve member 25 and a first and a second projection rod 18, 32 which are integrally formed at respective circumferential portions of the sleeve member 25 that are substantially opposite in a diametric direction of the sleeve member 25 and extend outward from the sleeve member 25 in the diametrically opposite directions. The sleeve member 25 is disposed radially outwardly of the center shaft 22 such that the rotation member 23 is rotatable about the center shaft 22. In the center shaft 22, there are also inserted a pair of sleeves 24, 24 disposed on both sides of the rotation member 23 in the axial direction of the center shaft 22, thereby positioning the cylindrical sleeve 25 in the substantially axially central portion of the center shaft 22. Each sleeve 24 is made of a metallic material, a rigid resin material or the like.

The first projection rod 18 protruding radially outwardly from the sleeve member 25 is a relatively long rod member having a diameter smaller than the circumferential width of the first window 34 and an axial length slightly smaller than the axial length of the first window 34. The first projection rod 18 is rotatable about the center shaft 22 between a first operational position as a retracting position, where the first projection rod 18 extends in the vertical direction as seen in FIG. 3 and is fully accommodated or retracted within the bore of the longitudinal stick member 12 as an accommodation recess, and a second operational position as a protruding position, where the first projection rod 18 extends in the horizontal direction as illustrated by two-dot chain line in FIG. 3, so as to radially outwardly protrudes from the longitudinal stick member 12. In order to define the first operational position, a stopper rod 38 is fixedly located behind the axially upper end portion of the first window 34 so as to extend in the diametric direction of the longitudinal stick member 12. Namely, the first operational position of the projection rod 18 is defined by collision of the protruding end portion of the first projection rod 18 with the stopper rod 38.

On the other hand, the second rod member 32 protrudes radially outwardly from the sleeve member 25 in a direction substantially diametrically opposite to the direction in which the first projection rod 18 is projected. The protruding end portion of the second projection rod 32 can protrude outwardly from the longitudinal stick member 12 through the second window 36. To this protruding end portion of the second rod member 32, there is securely bonded a spherical shaped mass member 16. As is apparent from FIG. 3, the mass member 16 is suitably bonded to the protruding end portion of the second rod member 32 such that the center of gravity "O" of the mass member 16 is offset or behind from the center axis of the center shaft 22 by an offset amount of "L" in the horizontal direction, when the first projection rod 18 is placed in the first operational position. When the first projection rod 18 is placed in the second operational position, on the other hand, the mass member 16 is rotatable about the center shaft 22 until the vertically lower end face of the mass member 16 is located above the axially lower end portion of the longitudinal stick member 12 in the vertical direction as seen in FIG. 3.

In the ambulatory assistance cane 10 constructed as described above, if the user lifts the cane 10, the first projection rod 18 is suitably held in the first operational position, namely, is kept accommodated or retracted within the bore of the longitudinal stick member 12 due to the gravity acting on the mass member 16. In other words, the mass member 16 has a mass large enough to produce a rotation moment or a torque causing a clockwise rotation of the rotation member 23 about the center shaft 22, due to the gravity acting on the mass member 16. Thus, when the user lifts the cane 10, the rotation member 23 is effectively held in the vertical attitude owing to the gravity acting on the mass member 16, keeping the first projection rod 18 fully retracted within the bore of the longitudinal stick member 12 with high stability.

Since the center of gravity of the mass member 16 is arranged to be offset from the center shaft 22 by the predetermined distance "L" in the horizontal direction, when the first projection rod 18 is placed in the first operational position, the rotation member 23 is constrained to made the clockwise rotation due to the gravity acting on the mass member 16, thereby effectively biasing the first projection rod 18 toward the stopper rod 38. Thus, the first projection rod 18 is kept accommodated within the bore of the longitudinal stick member 12 with high stability and reliability.

On the other hand, when the user leans on the cane 10 with the tip end of the cane 10, i.e., the mass member 16 put on a walking surface, the mass member 16 is subjected to a ground pressure "F" . Since the center of gravity "O" of the mass member 16 to which the ground pressure "F" is applied is horizontally offset from the axis of the center shaft 22 by the predetermined distance "L", the ground pressure "F" applied to the mass member 16 produces the rotation moment causing a counter clockwise rotation of the rotation member 23 about the center shaft 22, as seen in FIG. 3, resulting in a radially outward projection of the first projection rod 18 from the longitudinal stick member 12 through the first window 34. Thus, the first projection rod 18 is held in the generally horizontal attitude as depicted by two-dot chain line on FIG. 3.

The present cane 10 is arranged such that the spherical mass member 16 is rotatable in the counter clockwise direction about the center shaft 22, until the vertically lower surface of the spherical-shaped mass member 16 is located axially upwardly of the axially lower end face of the longitudinal stick member 12, thereby the axially lower end face of the longitudinal stick member 12 can be brought into contact with the walking surface. With the axially lower end face of the longitudinal stick member 12 held in abutting contact with the walking surface, the first and second projection rods 18, 32 are held in generally horizontal attitudes. That is, the first projection rod 18 protrudes outward from and perpendicular to the longitudinal stick member 12, so as to be held in the horizontal orientation, while the mass member 16 is supported by the walking surface. In other words, the axially lower end face of the longitudinal stick member 12 and the lower end face of the mass member 16 are held in contact with and supported by the walking surface, thereby first projection rod 18 is held in the second operational position where the first projection rod 18 substantially horizontally protrudes from the longitudinal stick member 12.

In this condition, the axially lower end face of the longitudinal stick member 12 is placed on or contact with the walking surface with high stability, permitting the present cane 10 to support the load or weight of the user applied thereto with high stability. Namely, the user's weight applied to the cane 10 is supported by the axially lower end portion of the generally rigid longitudinal stick member 12 rather than the spherical mass member 16, whereby the cane 10 of the present invention can support the user's weight with high stability, like in general canes.

Figure 4:
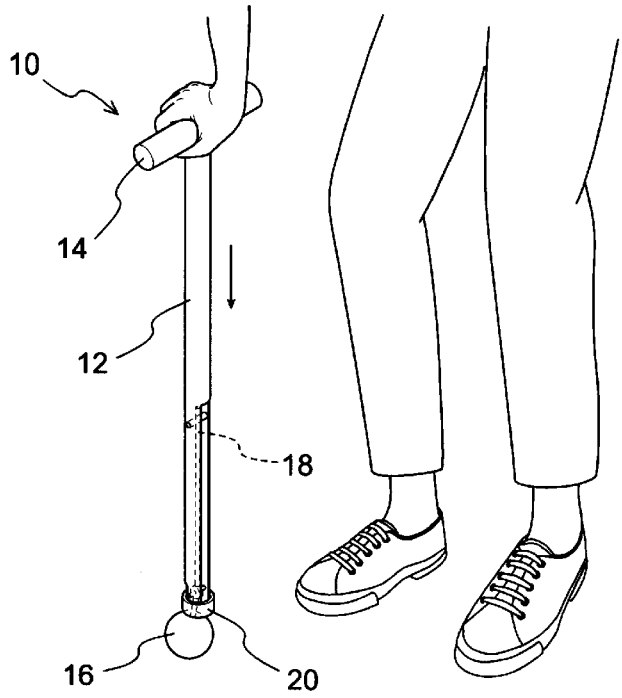
FIG. 4 is a perspective view of one operation mode of the cane of FIG. 1 where a first projection rod member is oriented vertically.
Figure 5:
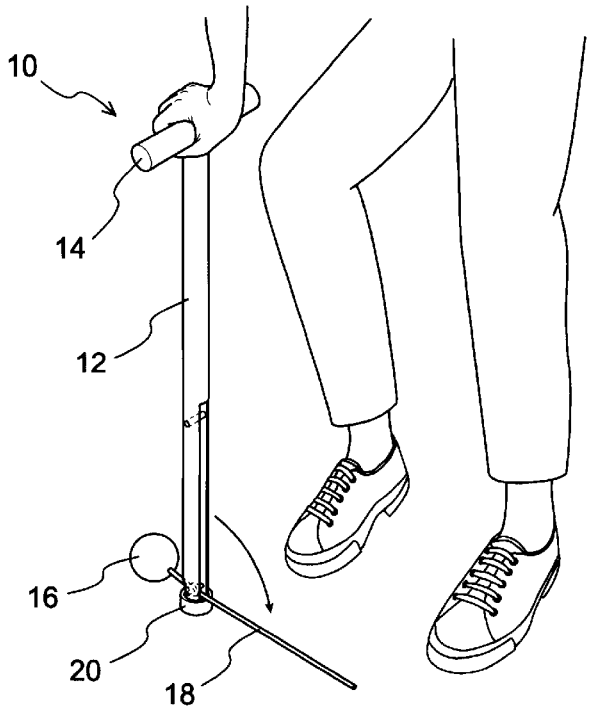
FIG. 5 is a perspective view of another operation mode of the cane of FIG. 1 where the first projection rod member is oriented horizontally.

Referring next to FIGS. 4 and 5, there are shown different operation modes of the ambulatory assistance cane 10 which is operated or used by a user. In FIG. 4, the user lifts the cane 10 so that no ground pressure is applied to the mass member 16. In this condition, the first projection rod 18 is held in the first operational position so as to be retracted within the bore of the longitudinal stick member 12, owing to the rotation moment based on the gravity acting on the mass member 16, which causes the clockwise rotation of the rotation member 23.

Then, the user puts the axially lower end face of the cane 10, i.e., the mass member 16 on the walking surface and applies a load (his or her weight) to the cane 10 in the vertically downward direction as indicated by an allow of FIG. 4, to thereby apply the ground pressure to the mass member 16. As depicted in FIG. 5, the contact portion of the mass member 16 with the working surface is smoothly moved in the horizontal direction along with the walking surface by the rotation of the mass member 16 about the center shaft 22. As the mass member 16 rotates about the center shaft 22, the first projection rod 18 protrudes outwardly from the longitudinal stick member 12, whereby the first projection rod 18 is placed in front of the user so as to extend in a direction perpendicular to the forwarding direction of the user. That is, the longitudinal direction of the first projection rod 18 intersects the direction of movement of the user, whereby the first projection rod 18 serves as a walking obstacle projecting into the path of the movement of the user's foot. Encountering the walking obstacle (the first projection rod 18) stimulate the user to step over the obstacle to avoid the same, effectively providing the user (Parkinson's patient) with a chance for starting his or her ambulatory movement. Therefore, the first projection rod 18 serves as the walking obstacle facilitates the ambulatory movement of the user (patient). Again the user lift the cane 10 so as to carry it, the mass member 16 is released from the ground pressure and then is subjected to the gravity, thereby producing the rotation moment which causes the clockwise rotation of the rotation member 23 about the censer shaft 22, due to the gravity applied to the mass member 16. Accordingly, the first projection rod 18 is promptly return to its first operational position so as to be retracted within the bore of the longitudinal stick member 12 as illustrated in FIG. 4.

In the ambulatory assistance cane 10 constructed according to the present embodiment, the load or weight of the user who lean on the cane 10 is effectively supported and assisted by the longitudinal stick member 12 whose axially lower end face is putted on the walking surface with sufficient stability, like in the conventional cane. In addition, the cane 10 requires the user only to lift and lean on the case 10 so as to automatically alternately place the first projection rod 18 in the first operational position where the first projection rod 18 is retracted within the bore of the longitudinal stick member 12 and the second operational position where the first projection rod 18 is protruded radially outwardly from the longitudinal stick member 12. Accordingly, the cane 10 is capable of temporally providing the first projection rod 18 as the walking obstacle in front of the user's foods only when the obstacle is required to induce the user to step forward. When the user does not need the walking obstacle, on the other hand, the user only requires to lift the case, so that the first projection rod 18 can be promptly retracted within the bore of the longitudinal stick member 12. In this condition, the walking obstacle can completely removed from where he or her step. Thus, the cane 10 is capable of assisting the ambulatory movement of the user, e.g., the Parkinson's patient with high efficiency. Besides, the cane 10 permits elimination of the conventionally experienced problem of insufficient retraction of the walking obstacle, that is, the first projection rod 18, thereby eliminating the problem of interruption of the ambulatory motion of the user by the insufficiently retracted walking obstacle.

The user may have an option to use the cane 10 with the second window 36 open to the right or left side of him or her, so that the first projection rod 18 never project into the path of the movement of the user's food.

Figure 6:
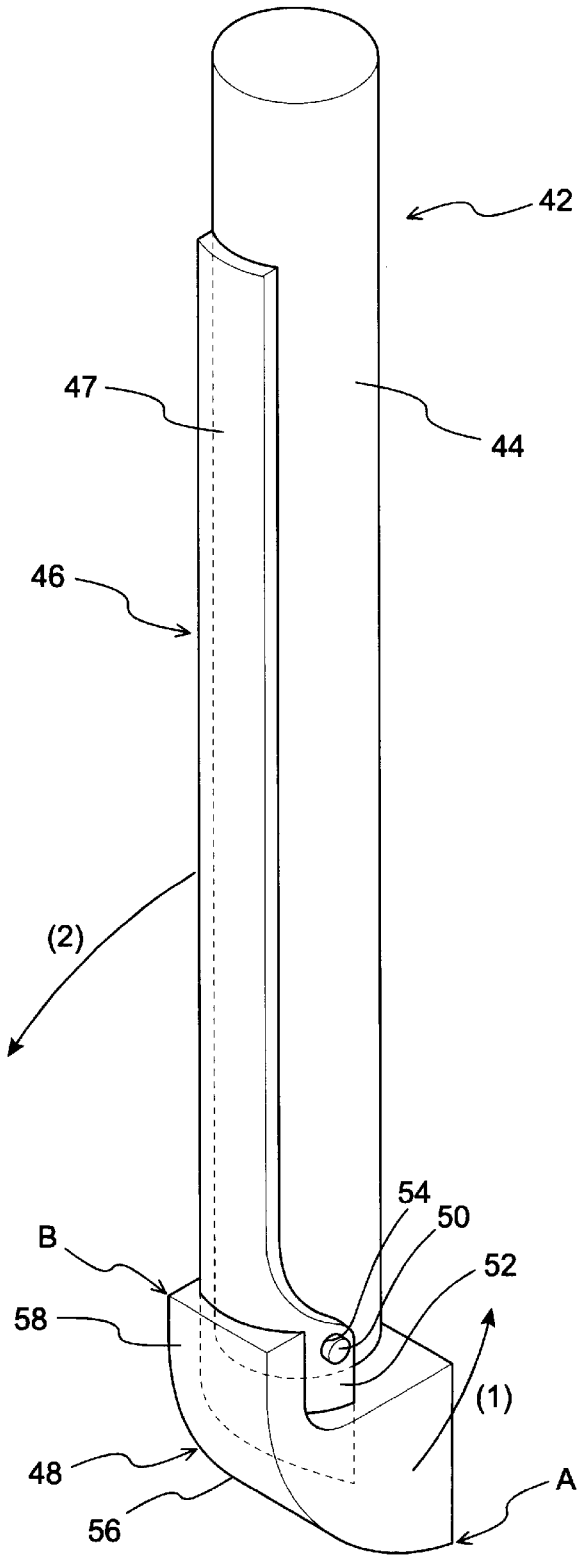
FIG. 6 is a perspective view showing another embodiment of an ambulatory assistance cane of the present invention.

Referring next to FIG. 6, there is shown a principle part of an ambulatory assistance cane 42 constructed according to a second embodiment of the present invention. In the following description, the reference numerals used in the preceding embodiment will be used to identify the corresponding elements, and no description of these elements will be provided.

The ambulatory assistance cane 42 includes a handle (not shown) and an longitudinal stick member 44 which is a solid rod-shaped member made of a rigid material such as metal, hard wood, reinforcing resin materials so that the stick member 44 is made rigid enough to support the weight of the user with stability. The longitudinal stick member 44 may be formed with known configurations and materials used in conventional canes.

In the axially lower end portion of the longitudinal stick member 44 as seen in FIG. 6, there is fixedly provided a center shaft 50 as a shaft member, so as to extend through the longitudinal stick member 44 in a direction perpendicular to the axial direction of the longitudinal stick member 44. The center shaft 50 is a rod shaped member made of a rigid material such as metal, and axially outwardly protrudes at its axially opposite ends from the outer circumferential surface of the longitudinal stick member 44.

To the axially lower end portion of the longitudinal stick member 44, there is also rotatably fixed projection plate 46 as a longitudinal projection member such that the projection plate 46 can rotate so as to protrude outwardly from the longitudinal stick member 44 in the diametric direction perpendicular to the axial direction of the longitudinal stick member 44. The projection plate 46 includes a projecting portion 47 and a fixing portion 52 at which the projection plate 46 is rotatably fixed to the longitudinal stick member 44. The projecting portion 47 is formed of a suitable material having given strength and durability, such as a metallic material and a reinforcing resin material, and is a thin plate-shaped member having a length the value of which is made sufficiently larger than that of its width and which is enough large to be served as a walking obstacle in front of the user, in other words, to project into the path of the movement of the user's food. The projecting portion 47 is curved in the width direction so as to have an arch shape, such that the inwardly curved surface of the projecting portion 47 substantially corresponds to the outer circumferential surface of the longitudinal stick member 44. The width of the projection plate 46 is enlarged in the circumferentially opposite directions at its one of longitudinally opposite end portions located on the side of the tip end of the longitudinal stick member 44, so as to provide the integrally formed generally semi-cylindrical fixing portion 52 extending in the circumferential direction with a circumferential length which is not less than half of the circumference of the longitudinal stick member 44. The fixing portion 52 has a through holes 54, 54 formed through its circumferentially opposite portions. The axially opposite ends of the center shaft 50, which protrude radially outwardly from the outer circumferential surface of the longitudinal stick member 44, further extend axially outwardly through the through holes 54, 54 of the fixing portion 52. The both protruding ends of the center shaft 50 are mashed so as to enlarge the diameters thereof, thereby preventing a drop of the center shaft 50. In this arrangement, the projection plate 46 is fixed to the outer circumferential surface of the longitudinal stick member 44, while being rotatable about the center shaft 50. In this embodiment, the longitudinal or axial end of the projection plate 46 on the side of the fixing portion 52 is positioned axially outward or downward of the lower axial end of the longitudinal stick member 44.

The ambulatory assistance cane 42 of the present embodiment, further includes a metallic mass member 48 which is fixed to the lower end portion of the fixing portion 52 of the projection plate 46. In this arrangement, the mass member 48 is rotatably movable about the center shaft 50 together with the projection plate 46. The material of the metallic mass member 48 may be suitably selected from the materials mentioned above with respect to the spherical-shaped mass member 16 of the first embodiment. The mass of the mass member 48 is made sufficiently larger than that of the projection plate 46. It should be noted that the configuration of the mass member 48 is not particularly limited, but may preferably arranged to have a curved surface at which the mass member 48 is brought into contact with the walking surface. In this embodiment, for example, the metallic mass member 48 has a raised portion 58 which is integrally formed at the axially upper end of the metallic mass member 48, as seen in FIG. 6. The raised portion 58 of the mass member 48 is fusion-welded at its radially inner circumferential surface to the outer circumferential surface of the fixing portion 52 of the projection plate 46. As indicated in FIG. 6, the mass member 48 has a an outwardly curved surface 56 extending between the axially or vertically lower end portion "A" and the axially or vertically upper end portion "B".

When the user lifts the ambulatory assistance cane 42 constructed as described above, the metallic mass member 48 is held in a first operational position where the axially lower end portion "A" is located nearest to the walking surface, due to the gravity applied to the metallic mass member 48. In this arrangement, the projecting portion 47 of the projection plate 46 is vertically oriented, such that the projection plate 46 extends parallel to and is forced toward the longitudinal stick member 44. Thus, the projection plate 46 is effectively retracted or accommodated on the side of the longitudinal stick member 44.

When the user puts the tip end of the cane 42 (i.e., the mass member 48) on the walking surface in order to lean on the cane 42, on the other hand, the ground pressure is applied to the metallic mass member 48, producing a rotation moment or a torque which causes a rotation of the metallic mass member 48 about the center shaft 50, in the direction indicated by the allows of FIG. 6. Accordingly, the contact portion of the mass member 48 with the walking surface is gradually transmitted from the axially lower end portion "A" to the axially upper end portion "B" along the outwardly curved surface 56. This rotation of the metallic mass member 48 about the center shaft 50 causes a rotation of the projection plate about the center shaft 50. Thus, the projecting portion 47 is rotated in a direction away from the longitudinal stick member 44, as indicated arrow (2) of FIG. 6, until the raised portion 58 of the metallic mass member 48 is finally brought into contact with the walking surface, whereby the projecting portion 47 is effectively protruded outwardly from the longitudinal stick member 44 of the cane 42.

The ambulatory assistance cane 42 constructed according to the present embodiment, can enjoy the same advantages described above with respect to the cane 10 according to the first embodiment. Namely, the cane 42 is capable of projecting the projecting portion 47 as the walking obstacle in front of the user's foots, when the user puts the cane 42 in front of him or her and leans on the cane 42 so as to step forward. The walking obstacle induces the user to step over the obstacle, thereby facilitating the ambulatory movement of the user. In addition, the cane 42 is arranged to be contact with the walking surface at the raised portion 58 of the metallic mass member 48, when the user's weight is applied to the cane 42, so that the longitudinal stick member 44 can support the user's weight with high stability.

Figure 7:
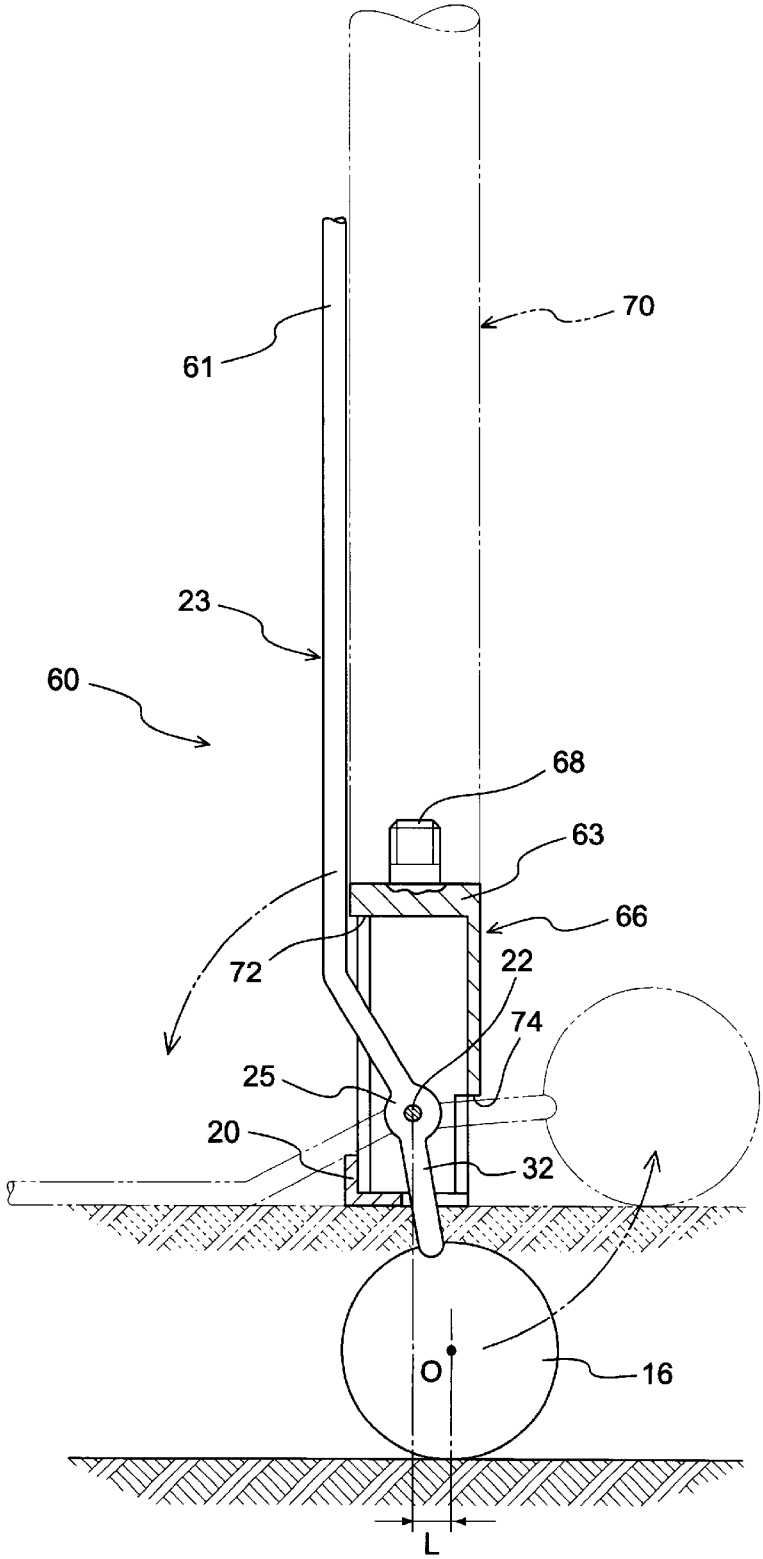
FIG. 7 is a vertical cross sectional view of one preferred embodiment of an ambulatory assistance attachment for a cane constructed according to the present invention.

Referring next to FIG. 7, there is shown an ambulatory assistance attachment 60 for a cane constructed according to one preferred embodiment of the present invention. The attachment 60 is attachable to a known cane so as to provide an ambulatory assistance cane of the present invention.

Described more specifically, the ambulatory assistance attachment 60 includes a body member 66 in the form of a hollow cylindrical member made of a rigid material such as metal and reinforcing resin materials. The body member 66 may be prepared by cutting a hollow cylindrical pipe with a suitable length. The attachment 60 further includes a disk-shaped closure member 63 integrally formed on one of axially opposite ends of the body member 66, i.e., an axially upper end as seen in FIG. 7, in order to close the opening of the axially upper end of the body member 66. A mounting bolt 68 is secured to the closure member 63 so as to protrude from the central portion of the closure member 63 in the axially upward direction of the attachment 60 as seen in FIG. 7. The attachment 60 can be easily attached to and removed from the tip end of the known cane through the bolt 68. The body member 66 of the attachment 60 has a first and second windows 72, 74 open in the respective circumferential portions of the outer circumferential surface thereof that are opposed to each other in the diametric direction thereof. The first window 72 has a rectangular shape with a relatively large axial length, while the second window 74 in the form of a rectangular shape has an axial length which is smaller than that of the first window 72. The axially lower end portions of the first and second windows 72, 74 are substantially covered by the tip end cover 20 which is radially outwardly disposed on the axially lower end portion of the body member 66 of the attachment 60.

Like in the cane 10 of the first embodiment, the center shaft 22 is fixedly disposed at the axially lower end portion of the body member 66 so as to extend in the direction perpendicular to the axial direction of the body member 66. The attachment 60 further includes the rotation member 23 which has the sleeve member 25 and a first projection rod 61 and the second projection rod 32. The first and second protruding rods 61, 32 are integrally formed at respective circumferential portion of the sleeve member 25, and extend in the generally diametrically opposite directions from the outer circumferential surface of the sleeve member 25. The sleeve member 25 of the rotation member 23 is rotatably disposed radially outwardly of the center shaft 22, so that the rotation member 23 (the first and second projection rods 61, 23) is rotatable about the center axis shaft 22. The first projection rod 61 is identical with the first projection rod 18 in its material and axial length, and is bent at a predetermined degree angle at its axially intermediate position. As the rotation member 23 is rotated about the center shaft 22 in the direction indicated by arrows in FIG. 7, the first projection rod 61 protrudes outwardly from the body member 66 of the attachment 60 through the first window 72.

The second projection rod 32 protrudes outwardly from the body member 66 of the attachment 60 through the second window 74. To the protruding end portion of the second projection rod, there is fixedly secured a spherical-shaped mass member 16. Like in the first embodiment, the center "O" of gravity of the spherical-shaped mass member 16 is arranged to be offset from the center axis of the center shaft 22 in the horizontal direction, by the distance "L" as shown in FIG. 7.

The attachment 60 constructed as described above can be installed on the known canes, crutches or other types of walking aids, whereby the known canes or other walking aids can provided with the same functions and advantages of the present invention as mentioned above with respect to the first embodiment of the present invention. As is apparent from FIG. 7, the attachment 60 may be installed on the tip end of a known cane 70. When the user lift the cane 70, the mass member 16 is located below the axially lower end of the attachment 60 due to the gravity acting on the mass member 16, so that the axially outward portion of the first projection rod 61 is held in vertical attitude so as to extend in the axial direction of the elongated cane 70. In this respect, the bending portion of the first projection rod 61 is bent with the predetermined degree angle as described above, so that the protruding end portion of the first projection rod 61 which protrudes axially outwardly from the bending portion of the first projection rod 61, extends generally in parallel to the cane 70. Thus, the first projection rod 61 is effectively retracted on and forced to the side of the cane 70, when the cane 70 is lifted by the user.

When the spherical mass member 16 is placed on the walking surface and the user's weight is applied to the cane 70, the ground pressure applied to the spherical-shaped mass member 16 produces a rotation moment or a torque which causes the rotation of the rotation member 23 or the first projection rod 61 about the center shaft 22. Accordingly, the first projection rod 61 protrudes outwardly from the side of the cane 70 and the axially lower end or the tip end cover 20 of the attachment 60 is held in contact with the walking surface, thereby sufficiently supporting the load or weight of the user applied to the cane 70.

The attachment 60 constructed according to this embodiment can be easily installed on or removed from the known cane, making it possible to adding ambulatory assistance functions to the known cane, as needed. For instance, the attachment 60 can be removed from the known cane, when the ambulatory assisting function is not needed, permitting separate handling of the cane and the attachment in maintenance and transportation. Besides, the ambulatory assistance attachment 60 permits partial repair of the present ambulatory assistance cane, leading to economical and efficient repair of the cane.

While the presently preferred embodiments of this invention has been described above in detail for the illustrative purpose only, it is to be understood that the present invention is not limited to the details of the illustrated embodiments, but may be otherwise embodied.

For instance, the walking assistance device and attachment constructed according to the present invention may optionally include an illumination system for illuminating the longitudinal projection member, so as to increase visibility of the longitudinal projection member especially in the darkness. This arrangement results in further improved safety of the user. The illumination system may be easily embodied by fixing a commercially available pen or key light to the body member of the walking assistance device with a suitable fastening member such as an elastic band.

Alternatively, a light emission equipment may be incorporated in the longitudinal projection member in order to increase visibility of the longitudinal projection member especially in the darkness. The light emission equipment may be suitably selected from a light emitting diode or other known emission device. The longitudinal projection member equipped with the light emission equipment may also be provided by simply coating the longitudinal projection member with self-luminous paint.

Further, the walking assistance device may optionally include a reflector or reflecting plate putted on the outer surface of the body member of the walking assistance device. The reflector is effective to keep the user safety during his or her walking especially at night.

While the center shaft as the shaft member is formed independently of the cane and the supporting member in the illustrated embodiments, the shaft member may be integrally formed with the cane or supporting member, for instance.

In the first embodiment, the stopper rod 38 is fixed in the longitudinal stick member 12 of the cane 10 for limiting the rotational displacement of the first projection rod 18 in the direction toward and relative to the longitudinal stick member 12. However, such a means for limiting the rotational displacement of the first projection rod in the direction toward and relative to the longitudinal stick member 12 may be provided on the side of the mass member 16, for example.

It may be possible to incorporate an elastic member in the present walking assistance device and the attachment, in order to apply a retracting force of the elastic member to the longitudinal projection member, for thereby supporting retracting movement of the projection member toward the side of the body member of the device.

While the longitudinal projection member is formed independently of the body member of the cane in the illustrated embodiment, alternatively, the projection member may be formed with a part of the body member which is arranged to be rotatable.

While the present invention is embodied in the form of the ambulatory assisting cane or attachment for canes, the principle of this invention is equally applicable to other types of canes, clutches, walkers and other walking assistance device.

It is to be understood that the present invention may be embodied with various other changes, modifications and improvements which may occur to those skilled in the art, without departing from the spirit and scope of the invention defined in the following claims:

What is claimed is:

1. A walking assistance device for assisting ambulatory movement of a user, comprising:

a body member to which a weight of said user is applied;

a shaft member fixedly disposed in a portion of said body member on the side of a walking surface so as to extend generally in a first horizontal direction;

a longitudinal projection member disposed rotatably about said shaft member so as to extend in a direction perpendicular to said shaft member; and a mass member which is disposed so as to oppose to said longitudinal projection member in a diametric direction of said shaft member, and which is integrally formed with said longitudinal projection member, said mass member having a contact portion at which said device is brought into contact with said walking surface, said contact portion being offset from an axis of said shaft member by a predetermined distance in a second horizontal direction perpendicular to said first horizontal direction so that a ground pressure applied to said mass member produces a rotation moment which causes rotation of said longitudinal projection member about said shaft member in one direction, said longitudinal projection member being held in a protruding position where said longitudinal projection member protrudes outwardly from said body member generally in said second horizontal direction, owing to said rotation moment produced by said ground pressure applied to said mass member, and being held in a retracting position where said longitudinal projection member extends in a generally vertical direction, owing to gravity acting on said mass member.

2. A walking assistance device according to claim 1, wherein said walking assistance device is a cane, and said body member includes a longitudinal portion, while said shaft member fixedly disposed in one of axially opposite end portions of said longitudinal portion on the side of said walking surface, so as to extend in a direction perpendicular to an axis of said longitudinal portion.

3. A walking assistance device according to claim 1, wherein said body member includes an accommodation recess for accommodating said longitudinal projection member which is held in said retracting position.

4. A walking assistance device according to claim 1, wherein said mass member having a spherical shape.

5. A walking assistance device according to claim 1, said device further comprising a stop member to limit an amount of rotational displacement of said longitudinal projection member relative to said body member in a direction toward said retracting position of said longitudinal projection member.

6. A walking assistance device according to claim 2, wherein said longitudinal portion having a hollow cylindrical shape and said shaft member disposed within a bore of said longitudinal portion.

7. A walking assistance device according to claim 3, wherein said longitudinal portion has a first and a second window both formed in said one axially opposite end portion thereof on the side of said walking surface and open in respective circumferential portions thereof that are opposed to each other in a diametric direction thereof, and said longitudinal projection member includes a first and a second rod members extend in a generally diametrically opposite directions of said shaft member, said first rod member being rotatably movable toward and away from said bore of said longitudinal portion of said body member through said first window, while said second rod member protruding outwardly from said bore of said longitudinal portion through the second window, and said mass member being fixedly secured to a protruding end portion of said second rod member.

8. A walking assistance device according to claim 4, wherein said second rod member being inclined by a predetermined angle with respect to an axial direction of said first rod member toward said second window.

9. A walking assistance device according to claim 1, further comprising an illuminating system for illuminating said longitudinal projection member.

10. A walking assistance device according to claim 1, further comprising a light emitting device fixed to said longitudinal projection member.

11. A walking assistance device according to claim 1, further comprising a reflector fixed to a part of said device.

12. A walking assistance attachment which is attachable to a walking assistance device for providing said walking assistance device defined in claim 1, said attachment comprising:

said shaft member; and said longitudinal projection member disposed rotatably about said shaft member, said attachment being attachable to a portion of a body member of said walking assistance device, which portion is located on the side of said walking surface.

* * * * *

UNITED STATES PATENT AND TRADEMARK OFFICE

CERTIFICATE OF CORRECTION

PATENT NO. : 6,378,540 B2
DATED : June 17, 2002
INVENTOR(S) : Takatsugi Iwasa

It is certified that error appears in the above-identified patent and that said Letters Patent is hereby corrected as shown below:

Title page,
Item [75], please delete "Takastugi" and insert -- Takatsugi --.

Item [73], please delete "Iwasi" and insert -- Iwasa --.

Signed and Sealed this

Twenty-third Day of July, 2002

*Attest:*

*Attesting Officer*

JAMES E. ROGAN
*Director of the United States Patent and Trademark Office*